US005440086A

United States Patent [19]

Kropf

[11] Patent Number: 5,440,086

[45] Date of Patent: Aug. 8, 1995

[54] UNBALANCE SWITCH MECHANISM

[75] Inventor: Keith E. Kropf, Newton, Iowa

[73] Assignee: Maytag Corporation, Newton, Iowa

[21] Appl. No.: 222,540

[22] Filed: Apr. 4, 1994

[51] Int. Cl.[6] ..... D06F 33/02; H01H 3/16

[52] U.S. Cl. ..... 200/61.62; 68/12.02; 68/12.06; 200/61.7; 192/136

[58] Field of Search ..... 68/12.01, 12.02, 12.06, 68/12.26, 12.27, 23 R, 23.1, 23.3; 192/136; 200/61.62, 61.69, 61.7, 61.76, 61.82; 292/261, DIG. 69

[56] References Cited

U.S. PATENT DOCUMENTS

| | | | |
|---|---|---|---|
| 2,882,360 | 4/1959 | Sisson | 200/61.7 |
| 2,921,155 | 1/1960 | Basso | 200/61.82 |
| 2,957,959 | 10/1960 | Mellinger | 200/61.76 |
| 3,051,313 | 8/1962 | Stelli | 210/144 |
| 3,145,818 | 8/1964 | Stelli | 192/136 |
| 3,227,835 | 1/1966 | Conrath | 200/61.45 R |
| 3,272,935 | 9/1966 | Beller et al. | 200/61.7 |
| 3,488,463 | 1/1970 | Mellinger | 200/61.76 |
| 3,504,772 | 6/1973 | Baker | 68/12.06 |
| 3,716,122 | 2/1973 | Baker et al. | 192/136 |
| 3,763,670 | 10/1973 | Harrold | 68/12.06 |
| 3,997,751 | 12/1976 | McNally | 200/61.62 |
| 4,098,098 | 7/1978 | Altnau | 68/23 R |
| 4,342,476 | 8/1982 | Brown et al. | 292/201 |
| 4,449,383 | 5/1984 | Cartier | 68/12.06 |
| 5,001,910 | 3/1991 | Harmelink et al. | 200/61.62 X |
| 5,038,587 | 8/1991 | Harmelink | 68/12.26 |
| 5,050,407 | 9/1991 | Wild | 68/12.06 |

*Primary Examiner*—J. R. Scott
*Attorney, Agent, or Firm*—Zarley, McKee, Thomte, Voorhees, & Sease

[57] ABSTRACT

A switch mechanism is provided for use in an appliance having a movable appliance member mounted therein for movement between a desired and an undesired position. A first switch is mounted on the appliance and is changeable from an open condition to a closed condition. A switch arm is moveably mounted to the appliance for movement from a first switch arm position permitting the first switch to be in one of its open or closed positions to a second switch arm position permitting the switch to be in the other of its open and closed conditions. The switch arm is moveable to a third switch arm position in response to movement of the moveable appliance member to its undesired position. In its third switch arm position the switch arm permits the first switch to return to its open condition.

18 Claims, 3 Drawing Sheets

12
10
42
2
2
34
3
3
28
30
32
36
50
16
52
24
26
14
18
10
12
20
24
38
44
40
42
48
46

4-4
5
6-6

UNBALANCE SWITCH MECHANISM

BACKGROUND OF THE INVENTION

The present invention relates to an unbalance switch mechanism.

Many different types of unbalance switches have been designed for centrifugal extractors such as washing machines operable through wash and spin-dry cycles. During the spin-dry operations, if an extreme unbalance condition occurs due to the uneven distribution of fabrics, the rotating tub of the extractor may gyrate violently. Unbalance switches are designed generally to open the circuit controlling the appliance during the extreme unbalance condition so that the machine is deenergized. The operator can then redistribute the clothes and restart the operation.

Therefore a primary object of the present invention is the provision of an improved unbalance switch mechanism.

A further object of the present invention is the provision of an improved self balance switch mechanism having a pivotal switch arm responsive to opening and closing of the appliance lid for causing the opening and closing of the unbalance switch.

A further object of the present invention is the provision of an improved unbalance switch mechanism having a switch arm which is self adjusting to accommodate the appliance lid during the first time that the appliance lid is closed and which will thereafter always close the unbalance switch in response to the closing of the appliance lid.

A further object of the present invention is the provision of an improved unbalance switch mechanism having a pivotal arm which responds to an unbalanced condition in the appliance by opening the unbalance switch.

A further object of the present invention is the provision of an improved unbalance switch mechanism which is economical to manufacture, durable in use, and efficient in operation.

SUMMARY OF THE INVENTION

The forgoing objects may be achieved, in a preferred embodiment, by a switch mechanism for use in an appliance having a supporting structure, a movable appliance member mounted to the supporting structure for movement between a desired position and an undesired position relative to the supporting structure, and a lid linkage mechanism moveable from a lid open position to a lid closed position. The switch mechanism includes a first switch mounted to the supporting structure of the appliance and being changeable from an open condition to a closed condition. A switch arm is movably mounted to the supporting structure for movement to first, second, and third switch arm positions. In the first switch arm position the switch arm permits the first switch to be in one of its open and closed conditions. In its second switch arm position the switch arm engages and holds the first switch in the other of its open and closed conditions. In its third switch arm position the switch arm releases the first switch and permits it to return to the original one of its open and closed conditions. The switch arm is movable from its first switch arm position to its second switch arm position in response to movement of the lid linkage mechanism from its lid open position to its lid closed position. The switch arm is also movable from its second switch arm position to its third switch arm position in response to movement of the movable appliance member to its undesired position.

DETAILED DESCRIPTION OF THE PREFERRED EMBODIMENT

Figures 3, 4, 5, 6, 7:
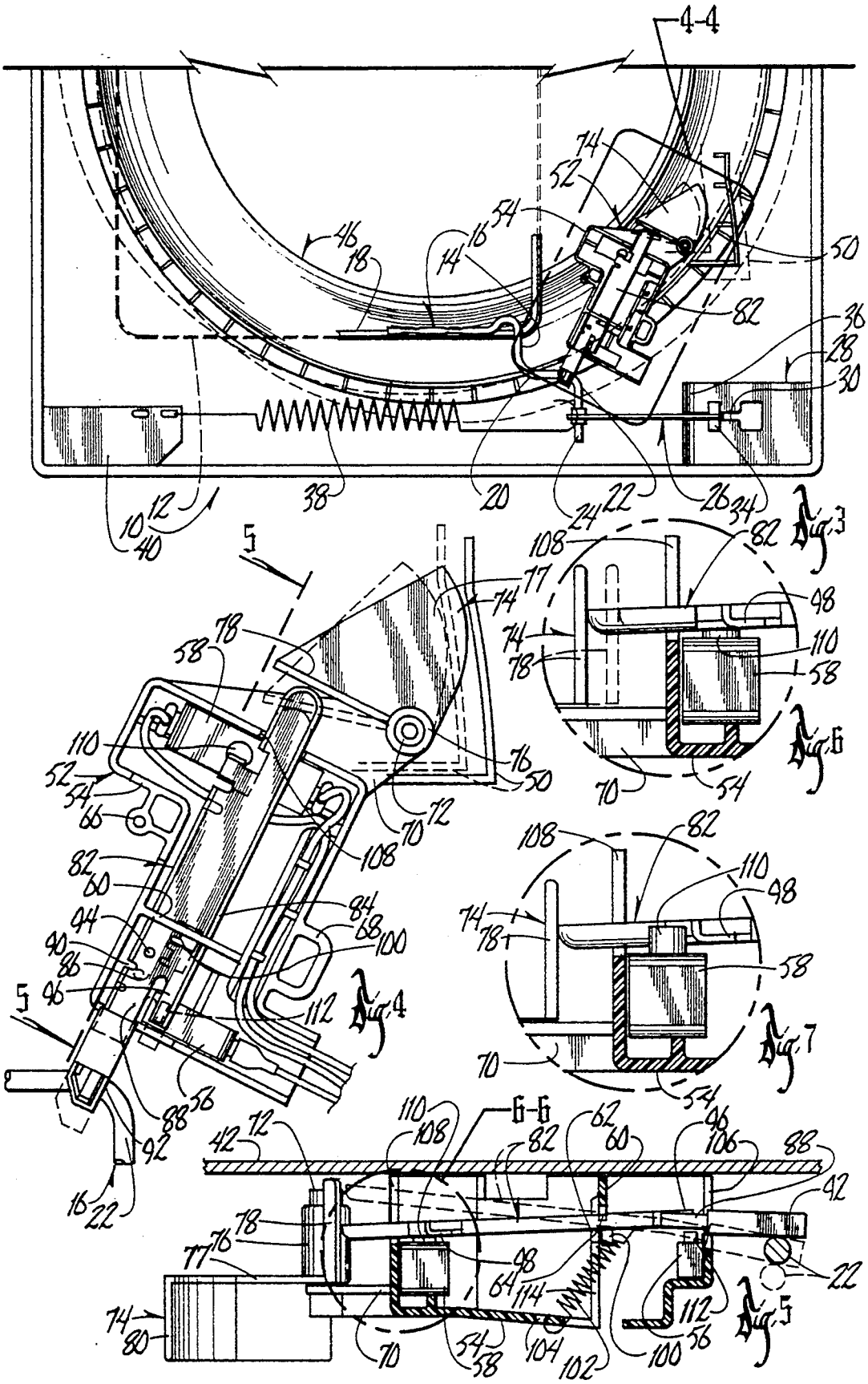
FIG. 3 is a sectional view taken along line 3—3 of FIG. 2.
FIG. 4 is an enlarged detail view taken along line 4—4 of FIG. 3.
FIG. 5 is a sectional view taken along line 5—5 of FIG. 4.
FIG. 6 is an enlarged detail view taken along line 6—6 of FIG. 5.
FIG. 7 is an enlarged detail view similar to FIG. 6, but showing the switch arm in a different position.

Referring to the drawings the numeral 10 generally designates a fabric washer utilizing the unbalance switch mechanism of the present invention. Washer 10 includes a hinged lid 12 which pivots about a hinge axis 14. Connected to the lid 12 is a crank arm 16 having a first leg 18 operatively attached to the lid 12. Crank arm 16 also includes a first elbow 20 and a second elbow 22 and terminates in a crank arm finger 24 (FIG. 3). The crank arm finger 24 is pivotally connected to one end of a link 26. The other end of link 26 is guided within a guide slot 30 of a guide member 28, and includes a pin 32 located below the slot 30 and a cam 34 positioned above the slot 30. Guide member 28 is provided with an upwardly curved lip 36 at its left end as viewed in FIGS. 2 and 3 which limits the movement of the link 26 to the left. A counter balance spring 38 has one end hooked to the link 26 and has the opposite end linked to an anchor plate 40 so as to yieldably urge the link 26 to the left as viewed in FIGS. 2 and 3.

Figures 1, 2:
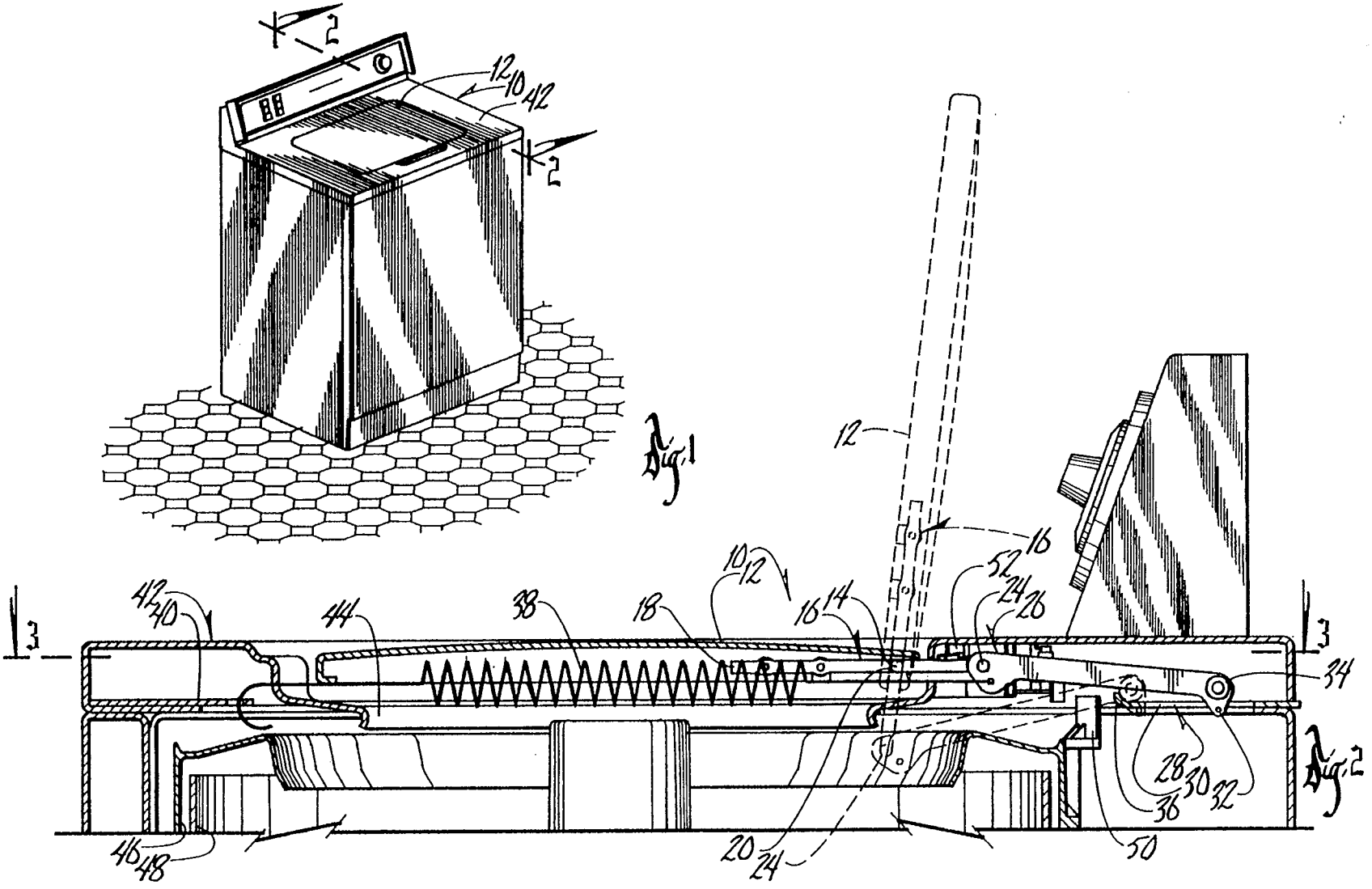
FIG. 1 is a pictorial view of an appliance utilizing the present invention.
FIG. 2 is a sectional view taken along line 2—2 of FIG. 1.

Referring to FIG. 2, the lid 12 is shown in its closed position in solid lines and is shown in its open position in shadow lines. In its open position the lid 12, forces the crank arm finger 24 downwardly thereby causing the link 26 to also pivot downwardly and move to the left as shown in shadow lines. When the lid 12 is closed the crank arm finger 24 pivots upwardly and to the right to the position shown in solid lines.

The washer 10 includes a top cover 42 including a lid opening 44 which is covered by lid 12 when in its closed position. Within the washer 10 are an outer tub 46 and an inner tub 48. Tub 48 is adapted to rotate about a vertical axis during the spin-dry cycle of the washing machine 10. Mounted to the upper edge of outer tub 46 is an unbalance actuating finger 50 which is adapted to engage an unbalance switch mechanism 52 whenever the spinning inner tub 48 is out of balance. During the spin portion of a cycle of operations, an unbalance situation sometimes occurs in inner tub 48 when the fabrics therein are distributed unevenly. This unbalance condition causes a wobbling erratic motion of the inner tub 48 about its axis, and in turn causes the outer tub 46 and unbalance finger 50 to move back and forth until it engages the unbalance switch mechanism 52.

The unbalance switch mechanism 52 includes a switch housing 54 (FIG. 4) which contains two spaced apart switches, a monitor switch 56 and an unbalance switch 58. Switch 58 may also be referred to as a lid switch 58. Between the two switches 56, 58, the switch housing 54 includes a fulcrum rib 60 which is vertically oriented and which includes a fulcrum opening 62 (FIG. 10) extending there through. Projecting downwardly from the upper edge of fulcrum opening 62 is a glide tab 64 which terminates in a lower end spaced slightly above the lower edge of the fulcrum opening 62. Switch housing 54 is mounted to the washing machine 10 by means of screws (not shown) which extend through mounting hole 66 and an enlarged mounting hole 68. The use of the enlarged hole 68 permits slight adjustment of the position of the switch housing 54 relative to the unbalance finger 50 carried by the outer tub 46.

Switch housing 54 also includes a horizontal trigger gusset 70 extending from one end and having a vertical trigger pivot pin 72 extending upwardly therefrom. Pivotally mounted over the trigger pin 72 is a trigger 74 having a sleeve 76 slideably fitted over the pivot pin 72. Trigger 74 includes a horizontal plate 77 which is somewhat pie shaped and which includes a vertical upwardly extending flange 78 on one side and a curved downwardly extending skirt 80 along its curved edge.

Figure 13:
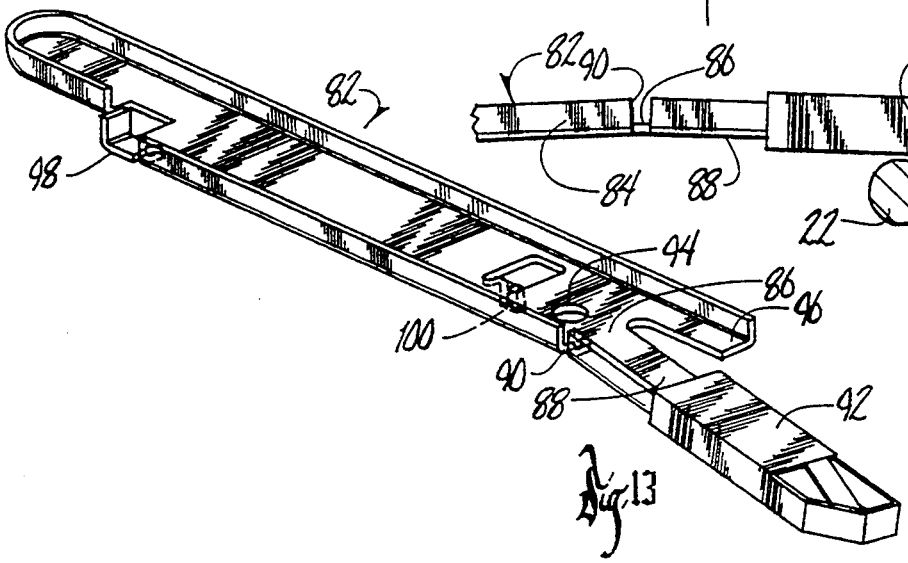
FIG. 13 is a pictorial view of the switch arm used in the present invention.

Extending through the fulcrum opening 62 of fulcrum rib 60 is an elongated switch arm 82 having a parametric upwardly extending flange 84 extending around its perimeter. Referring to FIG. 13 switch arm 82 includes a reduced cross-sectional portion 86 which forms the base of a lever 88. Adjacent the reduced cross-section portion 86 a flange cut or notch 90 is provided so that the lever 88 can bend along a bend line located at reduced cross-section portion 86 in response to a bending force being applied to the switch arm 82. The end of lever 88 is covered with a plastic lever cover 92. Switch arm 82 is also provided with a hole 94, with a projecting monitor switch actuator 96, and with an unbalance switch actuator or finger 98. Extending downwardly from the bottom surface of switch arm 82 is a slide limit finger 100.

Figure 8:
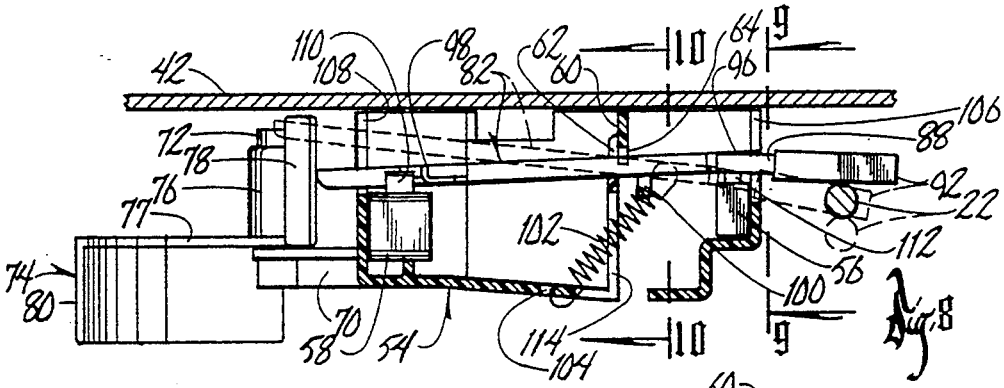
FIG. 8 is a sectional view similar to FIG. 5, but showing the switch arm in the position shown in FIG. 7.
Figure 9:
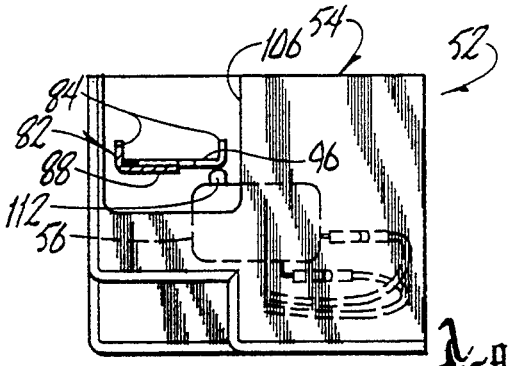
FIG. 9 is a sectional view taken along line 9—9 of FIG. 8.
Figure 10:
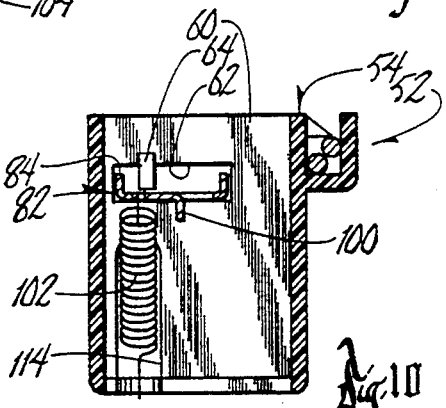
FIG. 10 is a sectional view taken along line 10—10 of FIG. 8.

The switch arm 82 extends slideably through the fulcrum window 62. A spring 102 has one of its ends connected to a hole 104 in the bottom of switch housing 52 and has the other of its ends connected to the hole 94 in spring arm 82. As can be seen in FIGS. 8 and 10, the spring 102 extends through a vertical slot 114 in fulcrum rib 60 and is inclined at an angle so as to urge the pivotal movement of spring arm 82 in a clockwise direction as viewed in FIGS. 6 and 8 and also so as to urge the spring arm 82 to the left as viewed in FIGS. 6 and 8. The slide limit finger 100 of spring arm 82 engages the vertical fulcrum rib 60 to limit the sliding movement of the switch arm 82 to the left. The opposite ends of the switch arm 82 extend through arm openings 106, 108 at the opposite ends of switch housing 52.

Referring to FIG. 5, the switch arm 82 is shown in shadow lines to be in a first position during the time that the lid 12 is in its open position with the crank arm 16 lowered as shown in FIG. 2. When the lid 12 is moved to its closed position the crank arm 16 pivots upwardly so that the second elbow 22 engages the under surface of the lever 88 and causes the switch arm 82 to pivot in a counter-clockwise direction about the fulcrum rib 60 to a second position shown in solid lines in FIG. 5. In this second position, the unbalance switch actuator 98 is registered with and engages an unbalance switch plunger 110 which is part of unbalance switch 58. Plunger 110 is yieldably urged to an upper position, but is yieldably moveable downwardly from its position shown in FIG. 7 to its position shown in FIG. 6. This downward movement is caused by the actuator 98 of switch arm 82 when the lid 12 is closed.

As can be seen in FIG. 5, when the switch arm 82 moves from its first position shown in shadow lines in FIG. 5 to its second position shown in solid lines in FIG. 5, the plunger 110 of unbalance switch 58 is bottomed out, and the monitor switch plunger 112 of monitor switch 56 is permitted to rise to its elevated position. When the switch arm 82 returns to its first position shown in shadow lines in FIG. 5, the plunger 110 of unbalance switch 58 is permitted to rise to its elevated position and the plunger 112 is depressed to its lower most position by the monitor switch actuator 96.

The switch arm 82 is movable from its second position shown in solid lines in FIG. 5 to its third position shown in FIG. 8 when an unbalance condition occurs with the rotating inner tub 48. In that unbalance condition, the unbalance finger 50 on the outer tub 46 begins to oscillate back and forth. If the magnitude of the oscillations become sufficiently great, the unbalance finger 50 will strike the skirt 80 of trigger 74 and force it to rotate in a counter-clockwise direction to the position shown in shadow lines in FIG. 4. This causes the vertical flange 78 of trigger 74 to urge the switch arm 82 longitudinally to its position shown in shadow lines in FIG. 4 and in solid line in FIG. 8. This movement is also illustrated in FIGS. 6 and 7, with FIG. 6 showing the position of the switch arm 82 before the unbalance condition occurs and with FIG. 7 showing the position of the switch arm 82 after the unbalance condition occurred. In this third position of the switch arm 82 shown in FIG. 7, the unbalance switch actuator has moved out of engagement with the plunger 110 of unbalance switch 58, thereby permitting the plunger 110 to move upwardly. This places the unbalance switch 58 in an open condition to deenergize washer 10 and stop rotation of the inner tub 48. In both its second position (solid lines FIG. 5) and its third position (solid lines FIG. 8), the switch arm 82 frees the plunger 112 of monitor switch 56 to stay in its upper position. Plunger 112 is only depressed when the switch arm 82 is in its first position shown in shadow lines in FIG. 5.

After an unbalance condition occurs, the switch arm 82 is moved to its third position shown by solid lines in FIG. 8, and the motor operating the spin-dry portion of the cycle of operations is deactuated. In order to reset the switch mechanism 52, the lid 12 is moved to its open position and at that point the switch arm 82 rotates in a clockwise direction to its first position shown in shadow lines in FIG. 5. Reclosing of the lid 12 causes the switch arm 82 to again move to its second position shown in solid lines in FIG. 5, thereby depressing the plunger 110 of unbalance switch 58 and permitting the reactuation of the motor for rotating the inner tub 48 in the spin-dry portion of the cycle of operations.

Figure 11:
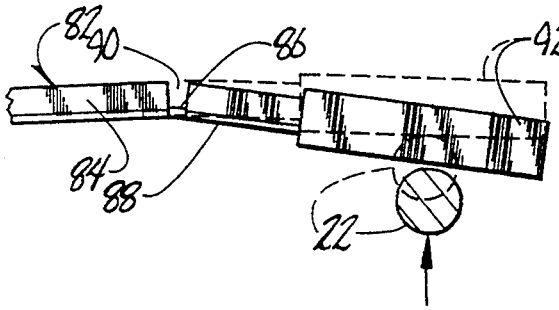
FIG. 11 is an enlarged detail view of the switch arm before it has been adjusted.
Figure 12:
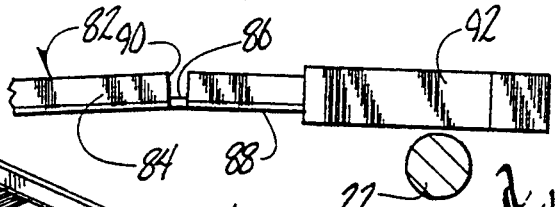
FIG. 12 is a detail view similar to FIG. 11, but showing the switch arm after it has been adjusted.

One important feature of the present invention is the self-adjusting nature of the switch arm 82. The first time that the lid 12 is closed after the installation of the unbalance switch mechanism 52, the crank arm 16 engages the lever 88 of switch arm 82 and urges it upwardly. At the time of installation, the angle of lever 88 with respect to the remainder of switch arm 82 is exaggerated to the position shown in FIG. 11. Thus as the crank arm 16 urges the lever 88 upwardly, the switch arm 82 moves in a counter-clockwise direction until the actuator 98 causes the plunger 110 of unbalance switch 58 to bottom out. At that point, the crank arm 16 continues to rise until the lid 12 is closed, and causes the lever 88 to be bent upwardly from the position in FIG. 11 to the position shown in FIG. 12. The bending occurs adjacent the notch 90 and the reduced cross-section portion 86. Thereafter, the switch arm 82 will retain its new bent configuration and whenever the lid 12 is moved to its closed position, the switch arm 82 will cause the switch plunger 110 to bottom out when the lid 12 is closed. Thus the reduced cross-section position 86 and the notch 90 permit the switch arm 82 to be self-adjusting during the initial closing of the lid 12.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A switch mechanism for use in an appliance having a supporting structure, a movable appliance member mounted to said supporting structure for movement between a desired position and an undesired position relative to said supporting structure, a lid and a lid linkage mechanism movable from a lid open position to a lid closed position, said switch mechanism comprising:

a first switch mounted to said supporting structure and being changeable from an open condition to a closed condition;

a switch arm pivotally mounted to said supporting structure and operable responsive to movement of said lid linkage mechanism from said lid open position to said lid closed position for pivotal movement from a first switch arm position permitting said first switch to be in one of its said open and said closed conditions to a second switch arm position engaging and holding said first switch in the other of its said open and said closed conditions;

said switch arm further being linearly movable in response to movement of said movable appliance member to said undesired position of said movable appliance member from said second switch arm position to a third switch arm position permitting said first switch to return to said one of said open and said closed conditions.

2. In combination:

an appliance supporting structure;

a movable appliance member mounted for movement from a desired position to an undesired position relative to said appliance supporting structure:

a lid movably mounted to said appliance supporting structure for movement between a lid open and a lid closed position;

a first switch mounted to said appliance supporting structure and being changeable between an open condition and a closed condition;

a switch arm pivotally mounted to said supporting structure for pivotal movement from a first switch arm position permitting said first switch to be in one of its said open and said closed conditions to a second switch arm position engaging and holding said first switch in the other of its said open and closed conditions, said switch arm being linearly movable in response to movement of said movable appliance member to said undesired position from said second switch arm position to a third switch arm position permitting said first switch to return to said one of said open and said closed conditions;

a lid mechanism responsive to movement of said lid from its said lid open to its said lid closed position to cause said switch arm to move from said first switch arm position to said second switch arm position.

3. A switch mechanism according to claim 1 or 2 and further comprising a trigger member movably mounted to said supporting structure and being engageable with said switch arm to move said switch arm to said third switch arm position in response to movement of said movable appliance member to said undesired position.

4. A switch mechanism according to claim 3 wherein said trigger member is positioned to be engaged and moved by said movable appliance member whenever said movable appliance member moves to said undesired position.

5. A switch mechanism according to claim 1 or 2 and further comprising bias means yieldably urging said switch arm toward said first switch arm position.

6. A switch mechanism according to claim 1 or 2 wherein said switch arm is elongated and includes a reduced cross section portion along its length whereby said switch arm will bend at said reduced cross section portion in response to being subjected to a bending force which exceeds a predetermined magnitude.

7. A switch mechanism according to claim 6 wherein said switch arm is bent during the first operation of said lid to said lid closed position thereby self-adjusting said switch arm with respect to said first switch.

8. A switch mechanism according to claim 1 or 2 wherein said switch arm is pivotally mounted about a horizontal switch arm axis for pivotal movement from said first switch arm position to said second switch arm position.

9. A switch mechanism according to claim 8 wherein said switch arm is movable in a horizontal direction from said second switch arm position to said third switch arm position.

10. A switch mechanism according to claim 1 or 2 and further comprising a second switch changeable from an open condition to a closed condition, said switch arm engaging and holding said second switch in one of its said open and said closed conditions when said switch arm is in its said first position, and said switch arm freeing said second switch to return to the other of its said open and said closed conditions when said switch arm is in its said second and third switch arm positions.

11. A switch mechanism for use in an appliance comprising:

a switch holder;

a first switch mounted to said switch holder and being changeable from an open condition to a closed condition;

a switch arm movably mounted to said switch holder for movement from a first switch arm position permitting said first switch to be in one of said open and said closed conditions to a second switch arm position engaging and holding said first switch in the other of said open and said closed conditions;

said switch arm being movable from said second switch arm position to a third switch arm position permitting said first switch to return to said one of said open and said closed conditions;

said switch arm being elongated and having a reduced cross section portion along its length whereby said switch arm will bend at said reduced cross section portion in response to being subjected to a bending force which exceeds a predetermined magnitude.

12. A switch mechanism according to claim 11 wherein said switch arm is pivotally mounted to said switch holder for pivotal movement about a pivot axis during movement from said first switch arm position to said second switch arm position.

13. A switch mechanism according to claim 12 wherein said switch arm is movably mounted to said switch holder for linear movement during movement from said second switch arm position to said third switch arm position.

14. A switch mechanism according to claim 12 wherein said reduced cross section portion of said switch arm is configured to cause said switch arm to bend along a bend axis substantially parallel to said pivot axis in response to being subjected to said bending force.

15. A switch mechanism according to claim 12 wherein said appliance includes a lid movable from a lid open to a lid closed position, said switch arm being movable from said first switch arm position to said second switch arm position and being bent in response to the first time said lid moves to said lid closed position, thereby self adjusting said switch arm with respect to said first switch.

16. A switch mechanism according to claim 12 and further comprising a second switch mounted to said supporting structure and being changeable from an open condition to a closed condition, said switch arm engaging and holding said second switch in one of said open and said closed conditions when said switch arm is in said first position, and said switch arm freeing said second switch to return to the other of said open and said closed conditions when said switch arm is in said second and said third positions.

17. A switch mechanism for use in an appliance having a supporting structure, a movable appliance member mounted to said supporting structure for movement between a desired position and an undesired position relative to said supporting structure, a lid and a lid linkage mechanism movable from a lid open position to a lid closed position, said switch mechanism comprising:

a first switch mounted to said supporting structure and being changeable from an open condition to a closed condition;

a switch arm having first and second opposite ends and being movably mounted to said supporting structure for movement from a first switch arm position permitting said first switch to be in one of its said open and said closed conditions to a second switch arm position wherein a first portion of said switch arm adjacent said first end thereof engages and holds said first switch in the other of its said open and said closed conditions;

said switch arm being movable from said second switch arm position to a third switch arm position permitting said first switch to return to said one of said open and said closed conditions;

said switch arm being movable from said first switch arm position to said second switch arm position in response to movement of said lid linkage mechanism from said lid open position to said lid closed position;

said switch arm being movable from said second switch arm position to said third switch arm position in response to movement of said movable appliance member to said undesired position;

a second switch changeable from an open condition to a closed condition, a second portion of said switch arm adjacent said second end thereof engaging and holding said second switch in one of its said open and said closed conditions when said switch arm is in its said first position, and said switch arm freeing said second switch to return to the other of its said open and said closed conditions when said switch arm is in its said second and third switch arm positions.

18. In combination:

an appliance housing;

a movable appliance member mounted for movement from a desired position to an undesired position within said appliance housing;

a lid movably mounted to said appliance housing for movement between a lid open and a lid closed position;

a first switch mounted to said appliance housing and being changeable between an open condition and a closed condition;

a switch arm having first and second opposite ends and being movably mounted to said housing for movement from a first switch arm position permitting said first switch to be in one of its said open and said closed conditions to a second switch arm position wherein a first portion of said switch arm adjacent said first end thereof engages and holds said first switch in the other of its said open and closed conditions, said switch arm being movable from said second switch arm position to a third switch arm position permitting said first switch to return to said one of said open and said closed conditions;

a lid mechanism responsive to movement of said lid from its said lid open position to its said lid closed position to cause said switch arm to move from said first switch arm position to said second switch arm position;

said switch arm being responsive to movement of said movable appliance member to said undesired position of said movable appliance member for causing said switch arm to move to said third switch arm position;

a second switch changeable from an open condition to a closed condition, a second portion of said switch arm adjacent said second end thereof engaging and holding said second switch in one of its said open and said closed conditions when said switch arm is in its said first position, and said switch arm freeing said second switch to return to the other of its said open and said closed conditions when said switch arm is in its said second and third switch arm positions.

* * * * *